US005669296A

United States Patent [19]

Newton

[11] Patent Number: 5,669,296

[45] Date of Patent: Sep. 23, 1997

[54] HIGH RATIO SCREW ACTUATED PRESS

[76] Inventor: Alan R. Newton, 67 Bluebird Ave., East Wareham, Mass. 02538

[21] Appl. No.: 566,729

[22] Filed: Dec. 4, 1995

[51] Int. Cl.[6] ..... B30B 1/18

[52] U.S. Cl. ..... 100/99; 72/454; 83/631; 100/231; 100/256; 100/289

[58] Field of Search ..... 100/52, 99, 231, 100/256, 289; 72/454; 83/631; 227/51, 55, 56

[56] References Cited

U.S. PATENT DOCUMENTS

| | | | |
|---|---|---|---|
| 239,721 | 4/1881 | Butler | 100/289 |
| 924,122 | 6/1909 | Williams | 100/289 |
| 954,449 | 4/1910 | Mead | 100/289 |
| 1,116,976 | 11/1914 | Bergstrom | 100/289 |
| 1,441,963 | 1/1923 | Bullis | 100/289 |
| 1,446,279 | 2/1923 | Szafka | 100/289 |
| 2,036,297 | 4/1936 | Ragan | 100/289 |
| 2,080,478 | 5/1937 | Hildebrand | 100/289 |
| 2,164,245 | 6/1939 | Kienzle | 100/231 |
| 2,482,082 | 9/1949 | Wahlberg | 74/459 |
| 2,525,326 | 10/1950 | Wahlmark | 74/424.8 |
| 2,616,302 | 11/1952 | Wahlmark | 74/459 |
| 2,831,363 | 4/1958 | Lohr | 74/424.8 |
| 3,165,007 | 1/1965 | Neubarth | 74/424.8 |
| 3,173,304 | 3/1965 | Strandgren | 74/459 |
| 3,380,316 | 4/1968 | Wilkinson | 74/424.8 |
| 3,426,574 | 2/1969 | Voronak | 100/289 |
| 3,595,094 | 7/1971 | Lemor | 74/89.14 |
| 3,614,900 | 10/1971 | Wahlmark | 74/424.8 |
| 3,861,221 | 1/1975 | Stanley | 74/25 |
| 3,861,226 | 1/1975 | Stanley | 74/89.15 |
| 3,965,761 | 6/1976 | Stanley | 74/89.15 |
| 4,648,285 | 3/1987 | Carson | 74/424.8 |
| 4,884,466 | 12/1989 | Duruisseau | 74/424.8 |
| 4,920,783 | 5/1990 | Greaves et al. | 100/289 |
| 4,964,314 | 10/1990 | Wilkes | 74/424.8 |

FOREIGN PATENT DOCUMENTS

| | | | |
|---|---|---|---|
| 585366 | 2/1925 | France | 83/631 |

*Primary Examiner*—Stephen F. Gerrity
*Attorney, Agent, or Firm*—James A. Geppert

[57] ABSTRACT

A high ratio screw actuated device used as a press to provide high pressure under small increments of movement which includes a frame or base for a housing rotatably carrying a screw having large pitch threads, a nut within said housing receiving said screw and having internal threads of the same pitch as the screw threads but a pitch diameter larger than the screw pitch diameter, a thrust/radial bearing encompassing said nut, a compression spring in said housing urging said nut downward, the free end of said screw carrying one piece of a two-piece die set, a guide rod having one end received in a socket in the frame, and a motor mounted on the guide rod for slidable movement thereof, the upper end of the screw terminating in a coupling receiving the drive end of the motor to engage the screw in rotational movement. A speed controller operated by a switch provides reversible rotation of the screw to advance and retract said screw and open and close the two-piece die, and a set screw acts to adjust the alignment of the centerlines of the screw and nut to adjust the ratio force of the press. Optionally, a torsion spring wrap clutch or resilient pawl engaging the nut outer surface prevents nut rotation in one direction which would otherwise prevent backing off of the screw.

29 Claims, 7 Drawing Sheets

HIGH RATIO SCREW ACTUATED PRESS

FIELD OF INVENTION

The present invention relates to a mechanical means for applying a squeezing pressure similar to a hydraulic press utilizing only mechanical components to apply a finite pressure in very small increments.

BACKGROUND OF THE INVENTION

Mechanical-type movements have been utilized in clamping devices for many years, such as in a C-clamp for use in woodworking or other types of applications wherein a screw-type arrangement includes an internally threaded housing or nut and an externally threaded shaft wherein the threads of the housing and shaft cooperate to advance or retract an anvil provided on the free end of the shaft; the opposite end of the shaft having an enlarged knob or similar handle to be grasped by the user to rotate the shaft and advance or retract the shaft.

In certain applications, the available pitch of the screw threads used for the internal and external threads is not sufficiently precise to allow for a very finite adjustment of the shaft where clamping pressures must be very small or increased in very small increments. This would be evident in applications such as in the application of grommets to canvas to provide anchoring holes in the canvas border for attachment to ropes or other anchoring devices. This invention solves that problem by providing a high ratio screw actuated press.

SUMMARY OF THE INVENTION

The present invention relates to a high ratio screw actuated press acting to provide a mechanical means of squeezing pressure similar to a hydraulic-type press using only mechanical parts. This invention will provide a means for changing the ratio of mechanical advantage with a mechanical adjustment, so that the press provides a method of providing higher ratios than is possible with a direct screw-type device. This is accomplished by utilizing a nut with an internal thread having a diameter larger than the diameter of the screw shaft which is engaged within it. The nut is held axially by bearings permitting the nut to spin freely about its axis, and the screw is turned by engagement of a hexagonal socket or equivalent engaging means on one end of the shaft. Turning is accomplished by hand through a hand crank or by an electric or other power source where available.

The present invention also comprehends the provision of a high ratio screw actuated press wherein ratio control of the screw press is accomplished by adjusting the alignment of the nut centerline for a nut having an enlarged threaded opening relative to the centerline of the threaded shaft; the nut being capable of being offset relative to the shaft. The smaller the offset between the screw and nut, the greater the ratio, and the greater the offset, the smaller the ratio. The threaded shaft and enlarged opening nut are both encompassed by a radial/thrust bearing contained within a housing having a setscrew mounted in one side so as to engage the exterior surface of the bearing and thus shift the axis of the nut. In addition, a pressure disc spring may be imposed between the setscrew and radial/thrust bearing.

DESCRIPTION OF THE PREFERRED EMBODIMENTS

Figure 1:
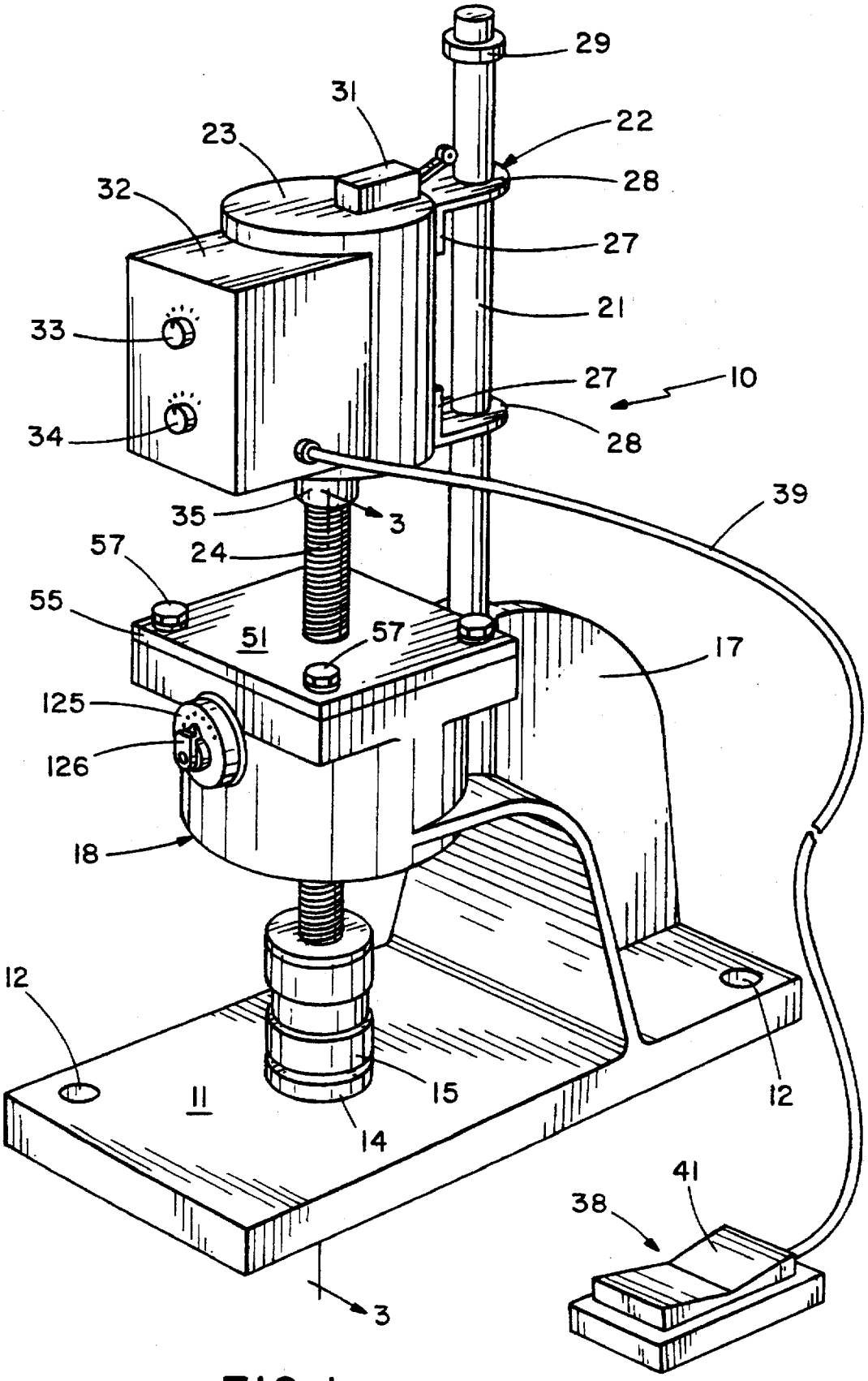
FIG. 1 is a perspective view of the screw actuated press of the present invention shown with an electrical control for the screw shaft.
Figure 2:
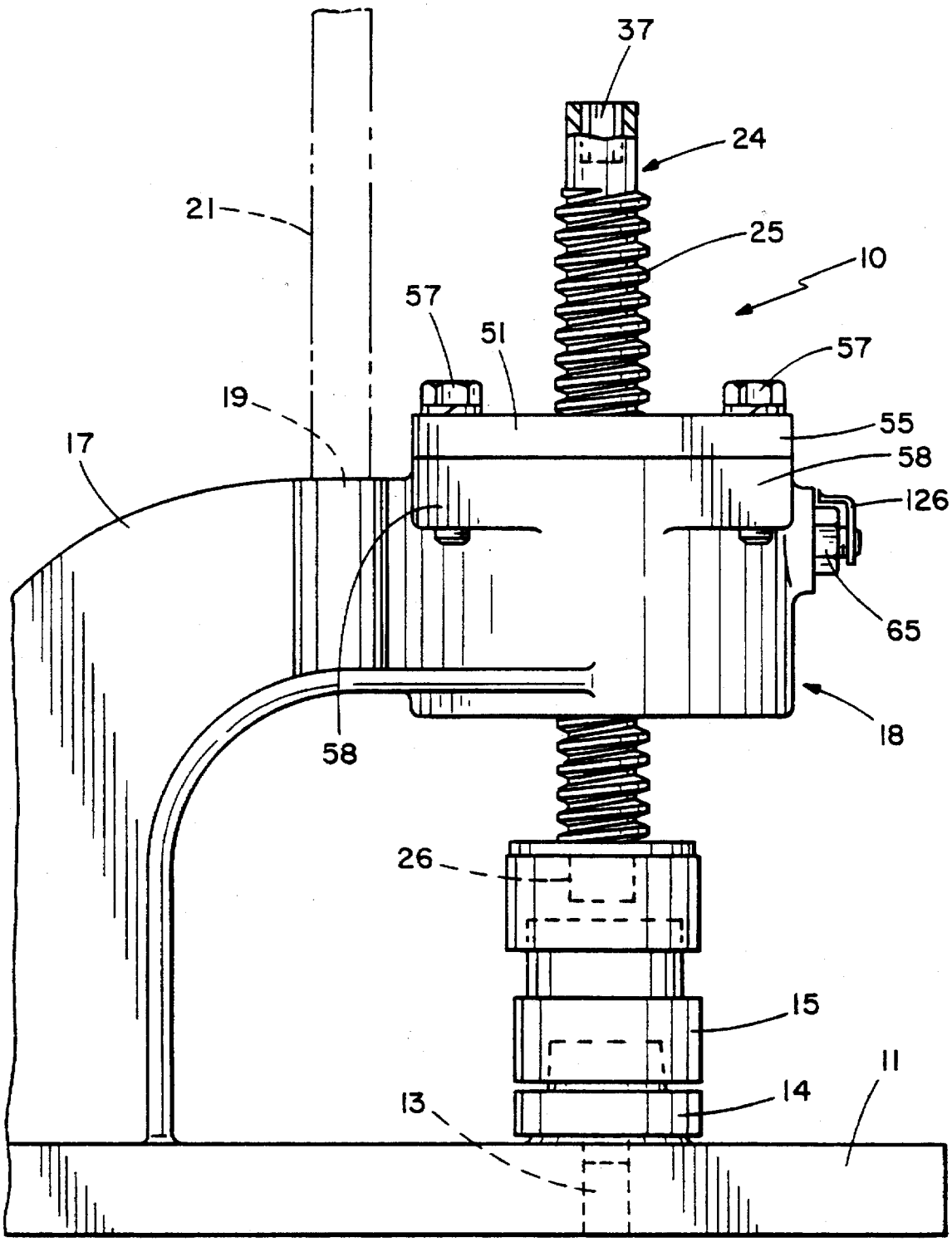
FIG. 2 is a side elevational view of the screw and housing showing the mounting of the press on the base.

Referring to the disclosure in the drawings wherein are shown preferred embodiments of the present invention, FIGS. 1 to 4 disclose a high ratio screw actuated press 10 for use in a controlled pressing operation, the press including a base plate 11 having bolt holes 12 for mounting the base to a bench or other suitable stand for the press, a generally vertical frame 17 which is suitably secured or mounted on the base plate, the frame terminating in a ratio mechanism housing 18 adjacent to a vertically oriented, enlarged socket 19 acting to receive a vertical guide rod or shaft 21 carrying a mounting bracket 22 for a motor 23 and speed controller 32 therefor to energize a rotatable shaft or screw 24 of the press; the screw having an exterior thread 25 formed thereon. The base plate includes an opening 13 to receive a die member 14 for a grommet 16, and the lower free end 26 of the shaft 24 carries a complementary die member 15 in a manner to be described later to enclose and press grommet parts **16*a*, 16*b* together to clamp the edge of an opening in a tarpaulin 20** or similar material.

The mounting bracket 22 for the motor consists of a pair of motor module guide rings 28, each ring joined to the motor housing by a mounting flange 27 with each ring encompassing the guide rod to allow vertical movement of the motor as it rotates the screw 24; the motor and speed controller being slidable by gravity on the control rod. An upper limit control ring 29 is positioned adjacent the upper end of the guide rod 21 to contact an upper limit switch 31 mounted on the exterior of the motor 23 to limit upward movement of the motor, and thus, the upper movement of the threaded shaft. A speed controller 32 is optionally assembled onto the motor and houses a speed control knob 33 and a torque control knob 34.

The motor drives a rotatable shaft 35 which may be rotated in either forward or reverse directions and terminates in a polygonal head adapted to be received in a complementary upper socket end 37 of the threaded shaft 24. A foot switch module 38 connected to an electrical outlet or power source has a power cord 39 extending between the module and the motor and controller; the module containing a rocker switch 41 having an up end and a down end of the switch so as to rotate the threaded shaft 24 in either clockwise or counterclockwise rotation.

The housing 18 formed on the upper end of the frame 17 is in the shape of a generally circular open-ended member 45 defining a main chamber 46 receiving an enlarged nut 47 having an internal thread 48 of the same pitch as the thread 25 of the shaft, but the pitch diameter 49 of the nut is larger than the pitch diameter of the threaded shaft or screw 24. An upper end cap 51 has a shouldered inner portion 52 received within the housing 18; the housing having a closed lower end 53 provided with a shoulder 54. The end cap 51 is provided with mounting flanges 55 at corners of the cap with openings to receive bolts 57 extending through the openings and into internally threaded ears 58 on the housing to secure the housing and end cap together.

The enlarged nut 47 is mounted within a thrust/radial bearing 61 on a shoulder 62 of the nut and positioned within the chamber 46 by a setscrew 64 extending through a threaded opening 63 in the housing. A locknut 65 threadingly engages the setscrew 64, and acts to engage the housing wall to lock the setscrew in a predetermined set position.

Figure 3:
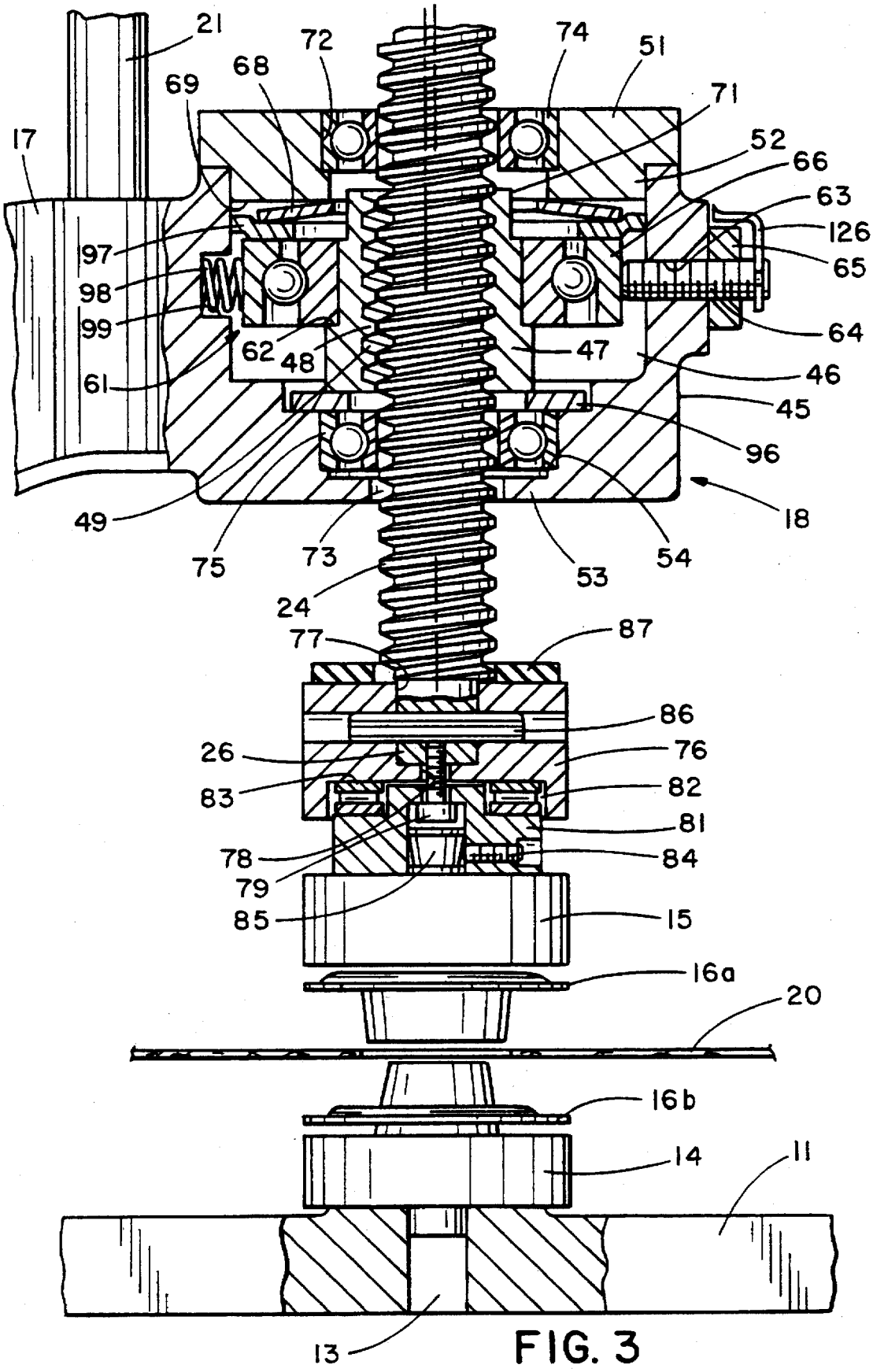
FIG. 3 is a vertical cross sectional view taken on the line 3—3 of FIG. 1 of the press ratio mechanism housing for the screw shaft and nut with the press in a retracted position.

Mounted within the chamber 46 between the upper end cap 51 and thrust/radial bearing 61 is a disc spring 68 bearing at its inner edge against the interior surface 69 of the end cap 51 and at its outer surface in positioning washer 97 shown in FIG. 3 which bears against the outer race 66 of the thrust/radial bearing 61; the upper end 71 of the nut 47 being reduced in diameter to prevent contact with the inner diameter of the disc spring. The step formed by the reduced diameter is the result of the difference between the inner diameter of the bearing and disc spring since the nut may be shifted to an off-center position relative to the central axis of the threaded shaft 24. Both the upper end cap 51 and closed lower end 53 have central openings 72 and 73, respectively, which receive a pair of radial bearings 74 and 75 that receive and frictionally engage the threaded shaft 24 to allow rotation of the shaft within the housing.

Mounted on the lower free end 26 of the shaft 24 is the grommet die 15 or similar member utilized in a pressing operation. A thrust bridge 76 having a central socket 77 is snugly fitted onto the free end 26 of shaft 24 and has a reduced diameter opening 78 to receive a socket head screw 79 threaded into the free end; a thrust bridge cap 81 being loosely received in a central cavity 82 in the thrust bridge mount 76 with the enlarged head of the screw 79 preventing the cap from falling off the shaft. A plurality of needle bearings 83 are mounted in the cavity to allow relative rotation between the mount and cap; the die 15 being suitably mounted and retained on the cap by a setscrew 84 engaging a tapered neck 85 of the die. Also, a stop pin 86 extends through the mount 76 and free end 26 to insure a fixed assembly therebetween, and a shock absorbing compressible pad 87 of a suitable plastic or rubber composition is positioned on the upper face of the mount.

Figure 6:
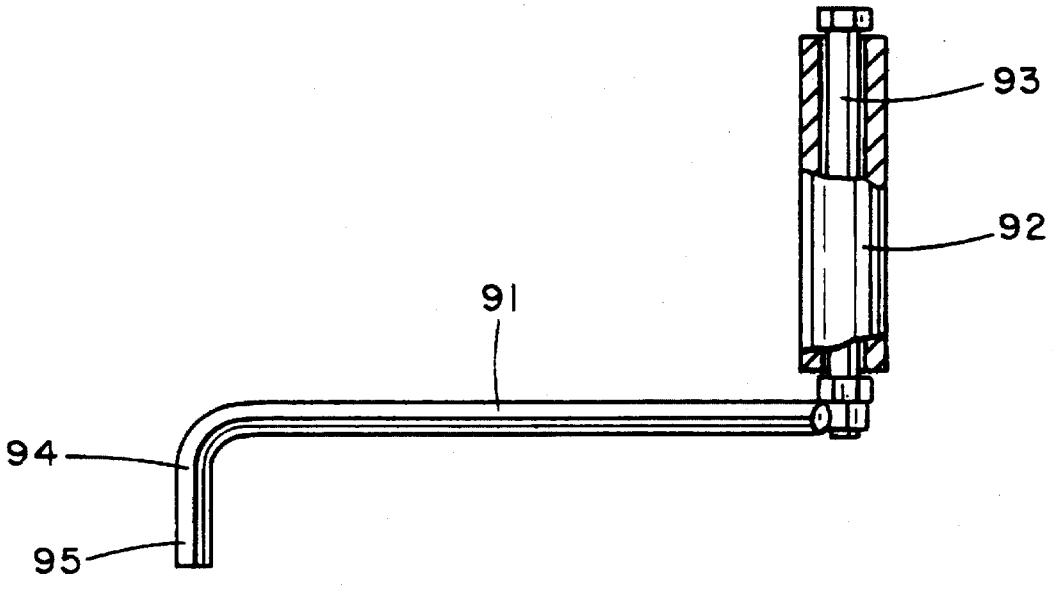
FIG. 6 is an elevational view of a hand crank for manual actuation of the threaded shaft of the press.

Shown in FIG. 6 is a hand crank 91 which may be used if the press is to be actuated manually to compress grommets or other articles requiring pressure for assembly. The crank 91 comprises a handle 92 rotatably mounted on the upper end 93 of the crank positioned at a right angle from the crank body, and the lower end 94 is also located at a right angle to the crank body with a polygonal end 95 to be received in the socket 37 of the shaft 24. A further alternate embodiment of actuating means for the shaft is the use of a portable motor (air, electric or any other suitable torque producing means) which has a polygonal head thereon to be received in the socket or any equivalent means of coupling at the upper end of the shaft.

Figure 5:
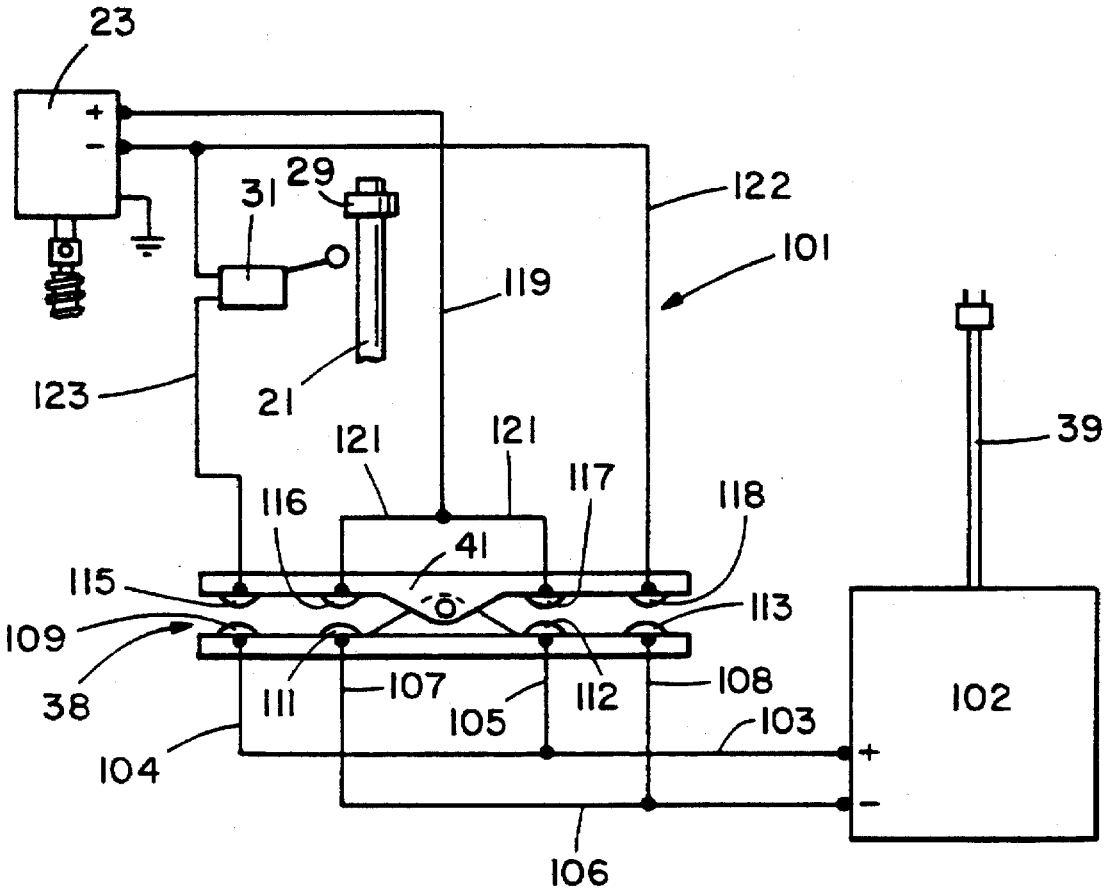
FIG. 5 is a schematic view of an electrical control system for actuation of the press.

FIG. 5 discloses a schematic diagram of a suitable circuit 101 for controlling the reversible electric motor 23 driving the screw 24. The circuit consists of a AC to DC current regulator 102 connected to a power source by the cord 39 and a pair of leads 103, 106 connecting the regulator to the foot switch module 38; each lead having two branches 104, 105 and 107, 108, respectively, connected to the four contacts 109, 111, 112 and 113 of the switch. The rocker 41 is pivoted on the base of switch module 38 containing the lower contacts, and the rocker has four contacts 115, 116, 117 and 118. A lead 119 to the plus side of the motor is connected by branches 121, 121 to the inner contacts 116 and 117 of the rocker, and a separate lead 122 is connected from the negative side of the motor to the contact 118. A branch 123 of lead 122 goes to contact 115 and includes the upper limit switch 31 mounted on the motor housing.

The needle bearing 83 acts as a thrust bearing to permit rotation of the screw shaft 24 under pressure without generating torque between the screw end face and the object under the screw while pressure increases. Thus, the cap 81 is free to rotate while the mount encases the bearing and applies pressure to the object which will be gradually squeezed. The bearings 74 and 75 guide the screw 24 and maintain lateral stability with the end cap 51 and lower end 53 housing the bearings. The disc spring 68 is preloaded by the end cap 51 at assembly; the preloading causing frictional engagement between the nut 47 and lower end 53 of the assembly (FIG. 3) by means of washer 96. The resistance enhances non-rotation of the nut 47 whereupon the screw shaft 24 traverses longitudinally on its axis at its predetermined pitch design of its threads 25; i.e., 0.25" pitch equals 0.25" travel per turn.

When the die 15 engages an object thereunder (FIG. 4), pressure builds which causes the disc spring 68 to collapse and flatten at a designed predetermined rate; this movement causing separation between the lower end 53 with washer 96 and the nut 47. The nut is then frictionally engaged with the screw threads 25.

The nut 47 has a thread diameter larger than the thread diameter of the screw 24, and the setscrew 64 urges the nut to be displaced in offset manner from the normal center line of the shaft. This off-center displacement causes frictional engagement between the internal threads 48 of the nut and the threads 25 of the screw 24; engagement taking place generally on the downward side of the press toward setscrew 64. Since the circumference of the nut thread is larger than the screw, a turn of the screw (360 degrees) is more than the degrees turn of the nut. The difference in rotationally induced travel interpolates to a relatively small traverse of the screw along its axis. The nut's rotation tends to induce rising of the screw while the normal pitch action of the screw causes downward movement. Since the screw rotated one full turn while the nut rotated less than one full turn due to the difference in circumference, the screw moves down slightly more than the nut causes its upward shifting. The closer diameters or, less difference, in size, the lesser will be the screw travel per rotation of the screw. By adjusting the setscrew 64 to force the nut off centerline of the screw, the ratio of screw traverse is controllable within design limits.

Figure 4:
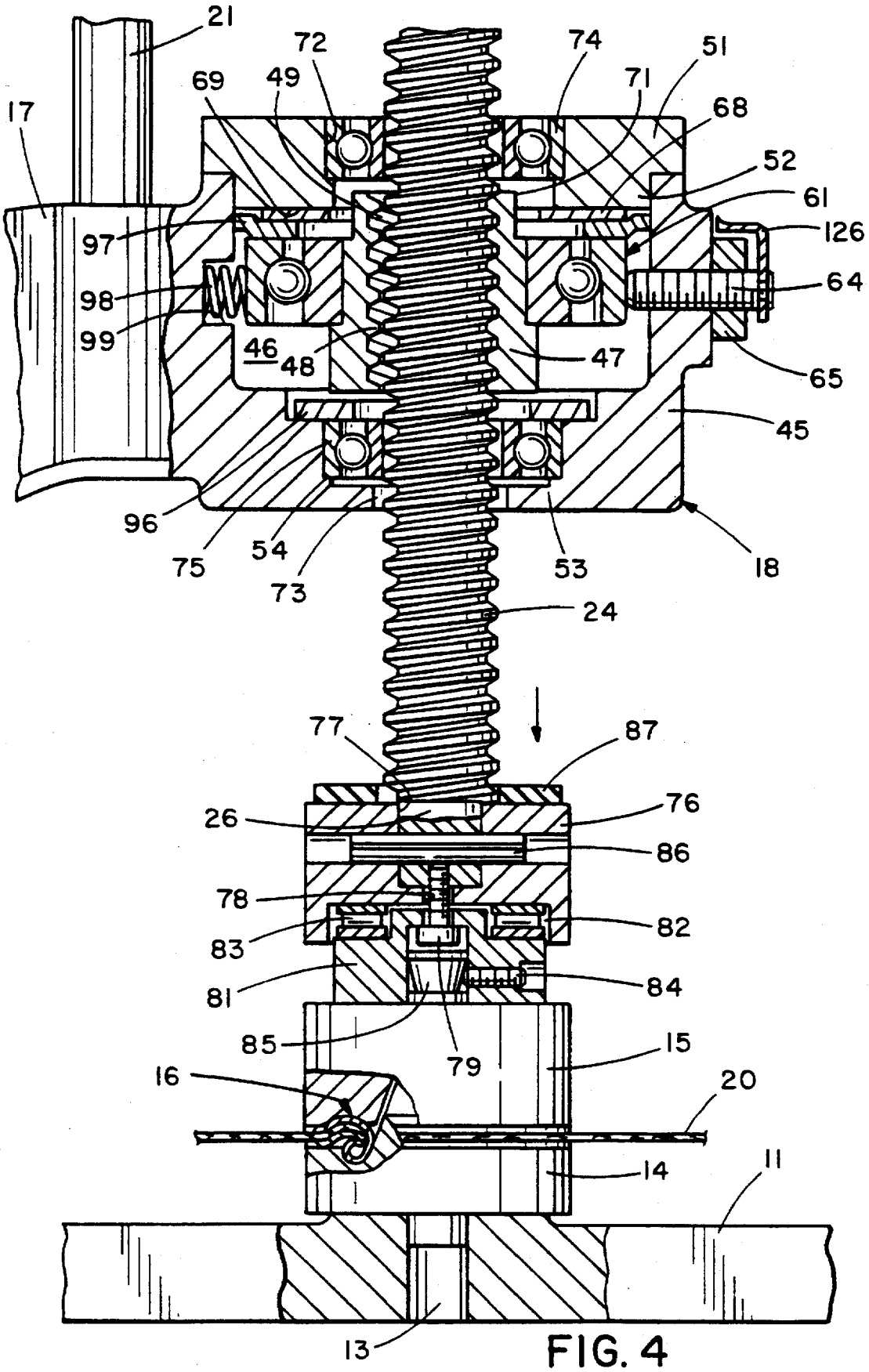
FIG. 4 is a cross sectional view similar to FIG. 3, but with the parts shown in the engaged position.

As seen in FIGS. 1, 3 and 4, the setscrew may be suitably designed with an index reference to preselect a designed ratio condition. Turning the setscrew 64 to shift the bearing and nut inward decreases the ratio while allowing the nut and bearing to shift to an aligned position relative to the screw will increase the ratio. Under pressure, the nut tends to slip toward the screw centerline, only the setscrew setting preventing concentricity of the nut to the screw. The thread provides a "cone" effect which at engaging has a "nesting" action between the nut and screw. It is also anticipated that a juxtapositioned screw may be on the relatively opposite side of the bearing and nut which will be equal to and opposite of setscrew 64; which provides a total control condition for the ratio.

Additional elements of the press shown in FIGS. 3 and 4 consist of a friction washer 96 positioned between the nut 47 and the bearing 75 in the bottom wall 53 and opposed to the disc spring 68 above the nut. Also located between the disc spring and the nut is a positioning washer 97 engaging the thrust/radial bearing 61 and the outer periphery of the disc spring 68 for use with the nut to improve the action of the screw. In operation, as the screw 24 turns, the cooperating nut 47 is held stationary due to friction between the nut and washer 96 adjacent the bottom of the housing. The disc spring 68 is under preload at assembly, which provides for frictional engagement of the nut 47 with the friction washer 96 and positioning washer 97 above and below the nut and the thrust/radial bearing 61 encompassing the nut. When the upper die holder 15 engages the anvil 14 for the die, the disc spring 68 deflects to relieve the friction on the nut.

FIGS. 3 and 4 disclose a further modification of the assembly wherein a compression spring 98 is positioned in a recess 99 opposite the set screw to enhance the movement of the nut toward the center of the screw when ratio adjustment is increased by the adjustment screw. As previously noted, the ratio is greater when the offset decreases, but when the center lines are coincident, there is no differential rotation movement of the nut when the screw is under working load, and the screw and nut rotate together when the disc spring 68 collapses enough to eliminate friction of the nut on the washer.

The ratio control for the screw is achieved by adjusting the offset of the nut centerline relative to the screw centerline. The smaller the offset, the greater the ratio, and the greater the offset, the smaller the ratio. This is adjusted by the setscrew piece wherein the locknut restricts accidental change of ratio. Further enhancement of the ratio control is to incorporate a rotary scale or index marking 125 for reference to a ratio setting which allows the user to willfully change to a chosen pre-existing setting. In this embodiment, index marks are located on the body of the housing and a pointer 126 is positioned on the setscrew through one or more thin locknuts on the setscrew to hold the pointer. An alternate embodiment of pointer resides in a pointed rod which is press-fitted in an opening drilled through the setscrew.

Here again, the ratio is provided by the action of the setscrew being displaced off-center relative to the nut thread. The ratio is the result of the difference in diameters (circumferences): for example, if a one inch diameter screw is displaced with a 1.01 inch diameter nut (thread), the ratio is 1.01 divided by 1.0. A 1"–4 pitch d=0.25 inch traverse per revolution. The screw rotates 360 degrees which causes the nut to rotate 1.0 divided by 1.01 or 0.99 times 360 degrees which is 356.44 degrees. The actual travel of the screw is 1.00–0.99, or 0.01 times 0.25 inch pitch which is 0.0025 inches per screw revolution. The ratio of force on the anvil under the screw face equals the force on the crank times the mechanical advantage. With a six inch radius on the crank handle and a twelve inch diameter crank circle, the crank travel circumference is 37.699 inches, divided by 0.0025 travel on the screw centerline gives a 15,079 to one pressure advantage or one pound times 15,079 pounds squeeze pressure. An electric drill producing ten pounds per inch torque provides 20,513 pounds squeeze force.

By adjusting the positioning setscrew which maintains the radial offset distance of the nut against the screw, the ratio mechanical advantage, hence pressure developed per unit force on the crank can be controlled. The pointer gauge with graduation marks can be on the adjusting screw for control reference.

In FIG. 3, the nut 47 is shown loaded by the disc spring 68 against the lower end washer 96 which provides frictional engagement between the nut and housing. This frictional resistance is a brake force so the screw moves at relatively high speed, equal to one lead pitch per screw revolution. When the force on the work causes the nut to raise up from the washer, the nut becomes ratio running as described.

Figure 7:
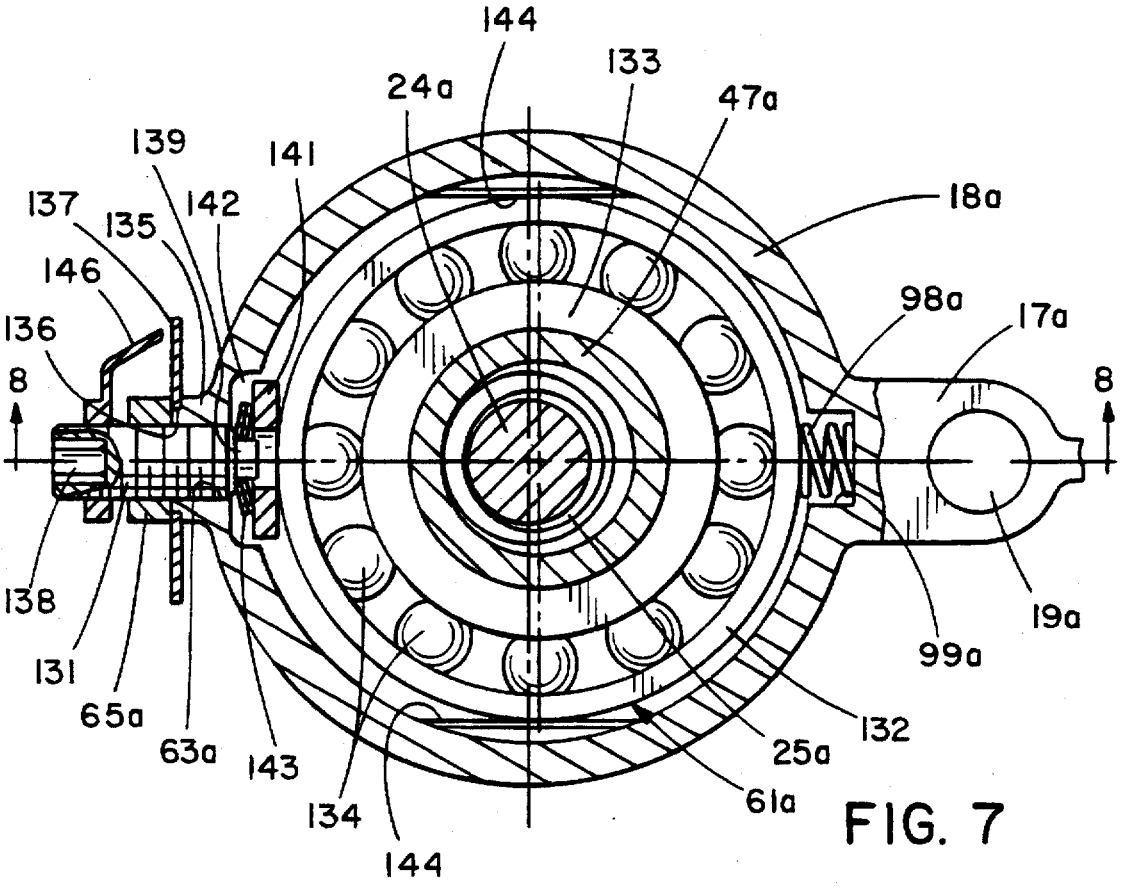
FIG. 7 is a horizontal cross sectional view of an alternate embodiment of adjusting screw for the nut and thrust bearing for creation of the ratio condition.
Figure 8:
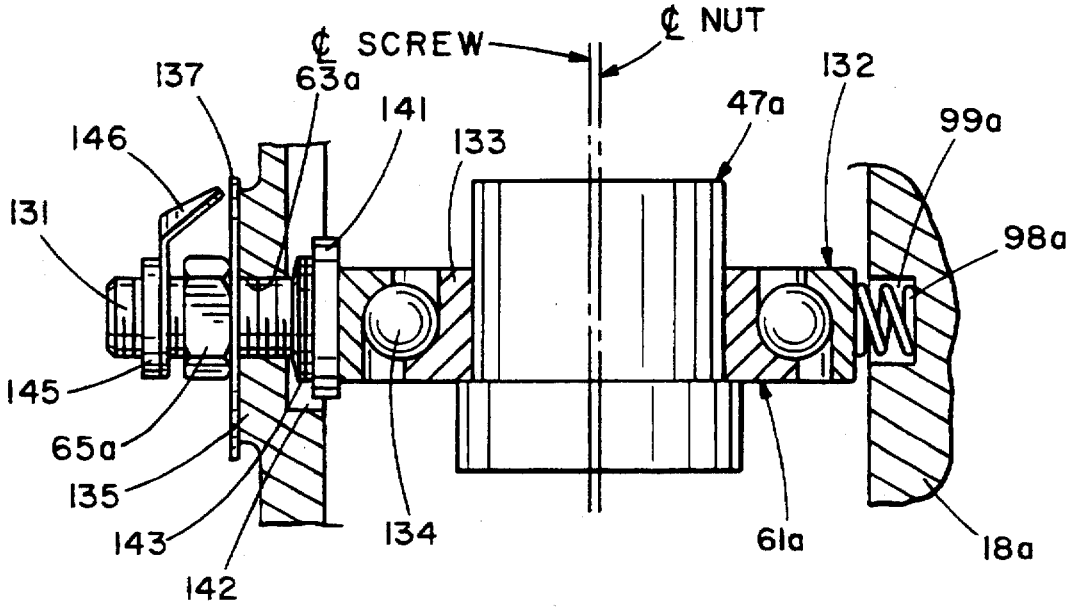
FIG. 8 is a cross sectional view taken on the line 8—8 of FIG. 7 but showing the nut in elevation.

FIGS. 7 AND 8 disclose an alternate embodiment of the nut adjusting setscrew wherein like parts are accorded the same reference numerals with the addition of a subscript "a". This assembly includes a housing **18*a* formed as part of the press frame 17*a* with the socket 19*a* to receive the lower end of the guide rod (not shown) and the internally threaded opening 63*a* for a setscrew 131 acting to adjust the nut 47*a* cooperating with the screw 24*a* within the central opening for the nut. The nut is encompassed by the thrust/radial bearing 61*a* which includes an outer race 132, an inner race 133 and a plurality of roller bearings 134**.

A compression spring **98*a* positioned in a recess 99*a* opposite the setscrew 131 acts to enhance the take-up of the looseness of the assembled parts in the press operating system. An enlargement 135 in the housing wall 18*a* to define the threaded opening 63*a* for the setscrew and a shoulder 136 at the end of the enlargement receives a position reference indicator card 137 mounted thereon and having appropriate markings to indicate the adjustment of the setscrew. The setscrew 131 includes a polygonal socket 138 at its outer end to receive an appropriate wrench for rotation of the setscrew and terminates at its inner end in a socket screw nib 139 projecting into a washer 141 received in a complementary recess 142 in the housing wall. A locknut 65*a* is positioned on the setscrew to bear against the enlargement 135 and a pointer 146 is mounted on a nut 145** threadedly engaging the threaded setscrew to cooperate with the indicator card.

One or more disc springs 143 are received on the nib 139 and act to urge the washer against the outer race 132 of the thrust/radial bearing **61*a* against the force of the compression spring 98*a*. Also, opposed bearing surfaces or guide faces 144, 144 are provided on the interior wall of the housing to provide a slip fit between the bearing outer diameter and housing to guide and position the bearing within the housing. The disc springs 143** are utilized due to the short compression stroke and high force factors of the assembly.

The disc springs are used as required to develop a spring force pushing the bearing/nut **47*a* off coincidental centerline alignment of the screw 24*a* to the nut. The socket setscrew 131 provides a means of controlling spring force against the bearing edge face. Since the Acme thread 25*a* has an angular shape in thread depth, the force developed against the work piece has a coincidental force radially which acts against the disc spring 68*a* (not shown). As force increases on the work end piece, the force also increases against the disc springs 143. The washer 141 provides a rigidly flat face to seat against the disc spring. The socket screw nib 139 takes up any side float by loosely engaging the inside diameter of the disc springs and provides alignment. As forces increase, the nut 47a drifts toward coincidental alignment of the screw and nut. The ratio of force also increases until alignment coincidence occurs. When the centerlines are coincident, the nut and screw will rotate together and no force increase will occur unless the socket setscrew 131** compresses the disc spring further.

Figure 10:
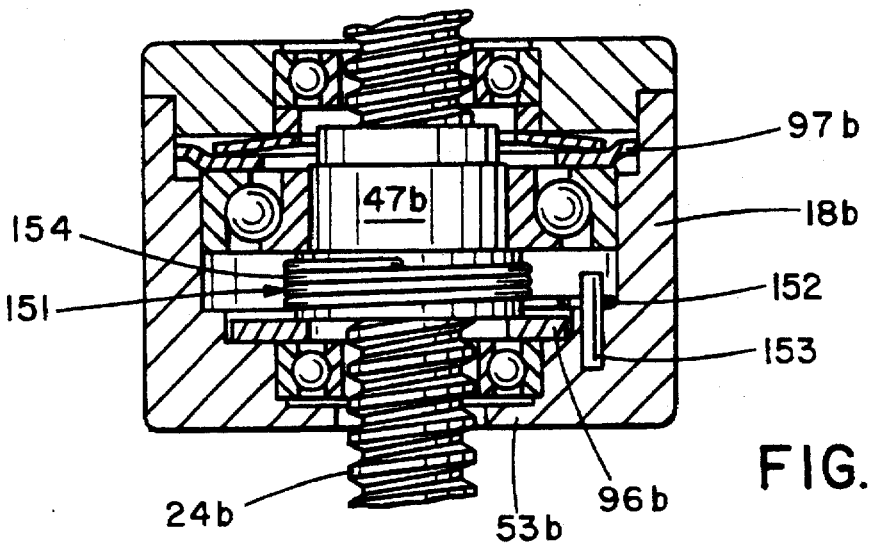
FIG. 10 is a vertical cross sectional view taken on the lie 10—10 of FIG. 9.
Figure 9:
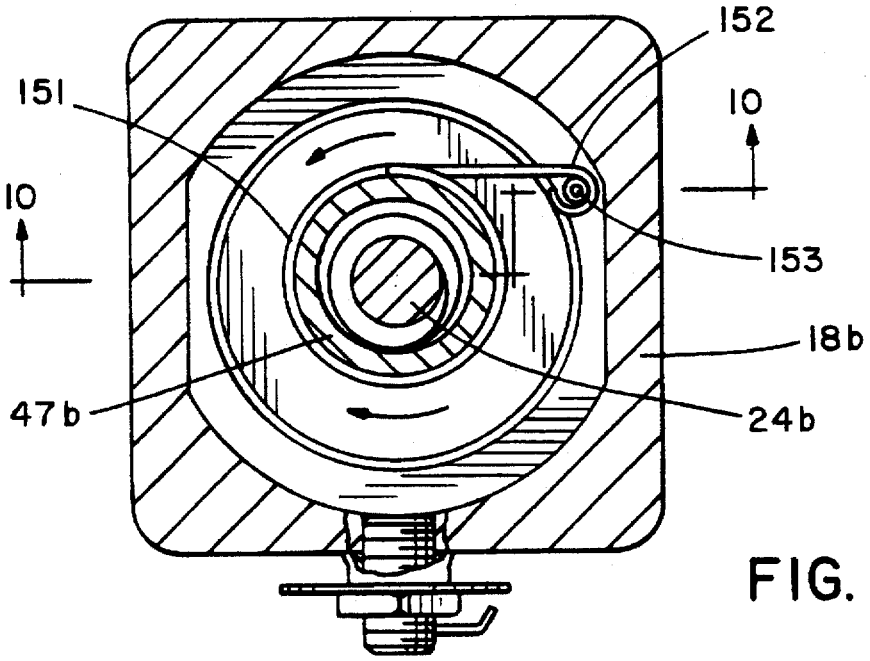
FIG. 9 is a horizontal cross sectional view of another alternate embodiment of the screw and nut utilizing a wrap-up clutch spring encompassing the nut.

Considering the embodiment of FIGS. 9 and 10, like parts are shown with the identical reference numeral with a subscript "b". There is disclosed in this version a torsion spring wrap clutch 151 on the outer diameter of the nut 47b having one end terminating in a loop 152 that is anchored over a pin 153 mounted in the lower closed end 53b of the housing 18b. Looking downward onto the nut in the housing in FIG. 9, as the nut 47b rotates in a counterclockwise direction, the coils 154 of the spring 151 tighten to provide a brake action to prevent retraction of the nut; hence allowing the screw to reverse rotation from the squeezing force and return to die-open position. However, when the nut rotates in a clockwise direction, it slips within the coil wrap.

When the centerlines of the screw and nut are coincident, which occurs at maximum set force limit, a brake action is needed to prevent nut rotation jointly with the screw 24b, which rotation would prevent backing off screw pressure and rotation. Friction braking of the nut holds the nut until the screw is backed off work and the washer 96b frictionally engages the nut face until the next cycle. Also, when the torsion wrap spring is used, sufficient friction can exist to hold the nut until "loading" occurs; hence, the disc spring may be unnecessary.

Figure 11:
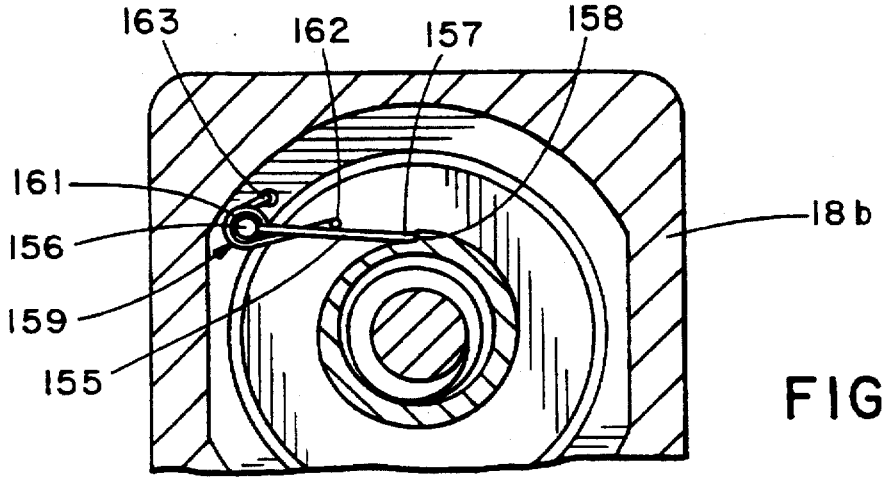
FIG. 11 is a partial horizontal cross sectional view of a further alternate embodiment of the screw and nut having a pawl allowing rotation of the nut in only one direction.

Similarly, as shown in FIG. 11, a pawl 155 can be used in place of the torsion spring, wherein the pawl has an integral pin 156 anchored in the housing 18b with the free end 157 of the spring pawl engaging the outer surface of the nut. The nut has a notch 158 formed therein engaged by the pawl free end 157 to prevent counterclockwise rotation of the nut, but clockwise rotation of the nut is allowed by the pawl. A torsion spring 159 has a loop 161 positioned over the pin 156 (pawl end pivot) with a spring tail 162 loading the pawl free end 157 and the opposing tail 163 anchored into the housing 18b.

Although the present device is disclosed as a screw actuated incremental press utilized for the operation of assembling grommets onto heavy-duty cloth, such as tarpaulin, this screw actuated device could be used in a number of other applications when incremental movement is required. As one example, the device may be utilized for a wheel pulling device where the lower screw end engages a wheel axle and appropriate clamping mechanism engages a wheel so that inward movement of the screw causes outward movement of the wheel and clamping device. Likewise, the device could be clamped onto a steel beam with a drill bit appropriately attached onto the free end of the screw and the device used as a drill driver for drilling through very hard surfaces where small incremental movement is required to penetrate the hard surface. Obviously, other uses for the device may become apparent where the device would be appropriate. Also, it is obvious that opposite hand threads and operating rotation of the parts will operate equally well as that shown.

I claim:

1. A high ratio screw actuated press for small incremental feed in a high pressure operation, comprising a frame including a base and a housing, an elongated screw rotatably mounted in said housing, said screw having an externally threaded surface with a pitch, an enlarged nut rotatably mounted in said housing and having an internally threaded surface with an identical pitch to the pitch of said screw, the nut having an internal pitch diameter, and the screw having an external pitch diameter, the internal pitch diameter of said nut being greater than the external pitch diameter of said screw, said screw having a lower end and an upper end, the upper end provided with a socket formed therein, means to rotate said screw including a driving end conformably received in said socket, means on said lower end of said screw for mounting a die thereon, and means mounted on said base below and axially aligned with said lower end of said screw for receiving a complementary die adapted to cooperate with said first mentioned die, the nut including a longitudinal centerline and the screw including a longitudinal axis, and means to adjust the longitudinal centerline of said nut relative to the longitudinal axis of said screw.

2. A high ratio screw actuated press for small incremental feed in a high pressure operation, comprising a frame including a base and a housing, an elongated screw rotatably mounted in said housing, said screw having an externally threaded surface with a pitch, an enlarged nut rotatably mounted in said housing and having an internally threaded surface with an identical pitch to the pitch of said screw, the nut having an internal pitch diameter, and the screw having an external pitch diameter, the internal pitch diameter said nut being greater than the external pitch diameter of said screw, said screw having a lower end and an upper end, the upper end provided with a socket formed therein, means to rotate said screw including a driving end conformably received in said socket, means on said lower end of said screw for mounting a die thereon, and means mounted on said base below and axially aligned with said lower end of said screw for receiving a complementary die adapted to cooperate with the die received in said lower end of said screw, and wherein the nut includes a longitudinal centerline and the screw includes a longitudinal axis, and further including means to adjust the longitudinal centerline of said nut relative to the longitudinal axis of said screw, said nut being capable of adjustment between a position of axial alignment between said longitudinal axis of said screw and said longitudinal centerline of said nut to a position where said longitudinal centerline of said nut is radially offset relative to said longitudinal axis of said screw.

3. A high ratio screw actuated press as set forth in claim 2, in which said nut is encompassed by a thrust/radial bearing received within said housing.

4. A high ratio screw actuated press as set forth in claim 3, wherein said housing is defined by a generally hollow body with a partially closed lower end and an opposite open upper end.

5. A high ratio screw actuated press as set forth in claim 4, wherein said thrust/radial bearing includes an outer race, and further including a compression spring located within said housing, said housing including a cap dosing said upper end of said housing, said compression spring having an inner diameter yieldably engaging said cap and an outer diameter engaging the outer race of said thrust/radial bearing.

6. A high ratio screw actuated press as set forth in claim 5, in which friction reducing bearings are positioned in said cap and lower end of said housing to rotatably support said screw to allow rotation of said screw.

7. A high ratio screw actuated press as set forth in claim 3, in which said housing is defined by a hollow body having a partially closed lower end and an open upper end, a cap received in said hollow body to substantially close the upper end, said nut and thrust/radial bearing encompassing said nut received in said hollow body, said lower end of said hollow body and said cap having central openings each receiving a radial beating to rotatably mount and guide said screw therein.

8. A high ratio screw actuated press as set forth in claim 7, wherein said hollow body includes a friction washer positioned between said roller beating received at the lower end of the hollow body and a lower end of said nut, and a compression spring located between said cap and an upper surface of said thrust/radial bearing for said nut.

9. A high ratio screw actuated press as set forth in claim 8, in which a positioning washer is located between said compression spring and said upper surface of said thrust/radial bearing for said nut.

10. A high ratio screw actuated press as set forth in claim 2, further comprising a bearing adjustably mounted within said housing, wherein said nut is received within said adjustable bearing, and wherein said means to adjust the centerline of said nut further comprises means for adjusting said bearing to thereby adjust the centerline position of said nut relative to said longitudinal axis of the screw.

11. A high ratio screw actuated press as set forth in claim 10, in which said means to adjust the centerline of said nut includes a setscrew projecting through said housing and engaging an outer surface of said adjustable bearing, and a locknut rotatably received on said setscrew for locking the setscrew in place.

12. A high ratio screw actuated press as set forth in claim 11, in which a compression spring is positioned in said housing opposite said setscrew for engaging an opposite outer surface of said adjustable bearing to urge said centerline of said nut toward said axially aligned position with said longitudinal axis of said screw.

13. A high ratio screw actuated press as set forth in claim 11, wherein rotation of said setscrew acts to urge said adjustable bearing to adjust the centerline of said nut to a position radially offset relative to the longitudinal axis of said screw.

14. A high ratio screw actuated press as set forth in claim 11, in which said setscrew terminates in a nib, a washer within the housing engaging the adjustable bearing and having a central opening receiving said nib.

15. A high ratio screw actuated press as set forth in claim 14, wherein at least one compression spring is positioned on said nib to urge said washer against the adjustable bearing.

16. A high ratio screw actuated press as set forth in claim 15, wherein said at least one compression spring acts as a means for controlling a pressing force of the press dies against a work piece, and as a means of controlling maximum force by allowing coincidence of the centerline of said nut and the longitudinal axis of said screw at a controllably adjusted condition.

17. A high ratio screw actuated press as set forth in claim 15, in which an additional compression spring is positioned in said housing opposite said setscrew to urge the centerline of said nut into coincidental alignment with said longitudinal axis of said screw.

18. A high ratio screw actuated press as set forth in claim 15, in which an indicator card including markings is mounted on said housing, and a pointer is molted on said setscrew to cooperate with said markings on said indicator card.

19. A high ratio screw actuated press as set forth in claim 14, in which a locknut threadedly engages said setscrew and cooperates with said housing to lock said setscrew in an adjusted position.

20. A high ratio screw actuated press as set forth in claim 2, in which said means on said lower end of said screw for mounting a die thereon includes an end and further includes a thrust bearing mount on said end, a thrust bearing cap loosely mounted on the end of said means on said lower end of said screw, and bearings located between said means for mounting and said thrust bearing cap.

21. A high ratio screw actuated press as set forth in claim 20, wherein said thrust bearing cap includes means for mounting a die onto said cap.

22. A high ratio screw actuated press as set forth in claim 20, wherein an impact absorbing compressible washer is positioned on said mounting for a thrust bearing facing said housing to absorb impact force resulting from rapid screw traverse upward.

23. A high ratio screw actuated press as set forth in claim 22, wherein a stop pin extends through said lower end of said screw and said means for mounting a thrust bearing to prevent rotation therebetween and maintain a fixed assembly condition against impact.

24. A high ratio screw actuated press as set forth in claim 2, further wherein said frame includes an upwardly and inwardly extending arm extending from said base and terminating in said housing, said arm having a blind opening therein to receive a guide rod, and wherein said housing encloses said means for rotating said screw, said means for rotating said screw including a motor slidably mounted on said guide rod, said motor having a shaft with a head complementary to and received in the socket in the upper end of said screw.

25. A high ratio screw actuated press as set forth in claim 24, wherein guides slidable on said guide rod are attached to said motor, and a switch is connected to said motor to provide reversible rotation thereof.

26. A high ratio screw actuated press as set forth in claim 25, in which a limit switch is positioned on said motor and engagable with an upper limit control ring on the upper end of said guide rod.

27. A high ratio screw actuated press as set forth in claim 2, in which a torsion spring wrap clutch encompasses an outer surface of said nut to allow rotation of said nut in only one direction.

28. A high ratio screw actuated press as set forth in claim 27, wherein said wrap clutch includes a coil spring wrapped around said nut, said coil spring having a loop at one end anchored on a pin in said housing.

29. A high ratio screw actuated press as set forth in claim 2, in which a resilient pawl is positioned within said housing on a pin anchored therein, and said nut includes a notch on its outer surface adapted to be engaged by said pawl to prevent rotation of said nut on one direction.

* * * * *